US009234487B2

(12) United States Patent
Cooke

(10) Patent No.: US 9,234,487 B2
(45) Date of Patent: Jan. 12, 2016

(54) INJECTION NOZZLE

(75) Inventor: Michael Peter Cooke, Gillingham (GB)

(73) Assignee: Delphi International Operations Luxembourg S.A.R.L., Luxembourg (LU)

( * ) Notice: Subject to any disclaimer, the term of this patent is extended or adjusted under 35 U.S.C. 154(b) by 0 days.

(21) Appl. No.: 14/241,116

(22) PCT Filed: Sep. 4, 2012

(86) PCT No.: PCT/EP2012/067209

§ 371 (c)(1),
(2), (4) Date: Feb. 26, 2014

(87) PCT Pub. No.: WO2013/034543

PCT Pub. Date: Mar. 14, 2013

(65) Prior Publication Data

US 2014/0291422 A1 Oct. 2, 2014

(30) Foreign Application Priority Data

Sep. 8, 2011 (EP) ..... 11180619

(51) Int. Cl.
*F02M 61/10* (2006.01)
*F02M 61/12* (2006.01)
*F02M 47/02* (2006.01)

(52) U.S. Cl.
CPC ..... *F02M 61/12* (2013.01); *F02M 47/027* (2013.01); *F02M 61/10* (2013.01); *F02M 2200/28* (2013.01)

(58) Field of Classification Search
CPC .... F02M 61/10; F02M 61/12; F02M 2200/28
See application file for complete search history.

(56) References Cited

U.S. PATENT DOCUMENTS

| | | | | |
|---|---|---|---|---|
| 6,422,208 | B1 | 7/2002 | Ertem et al. | |
| 6,499,467 | B1 * | 12/2002 | Morris et al. | 123/467 |
| 7,059,548 | B2 | 6/2006 | Reiter et al. | |
| 7,188,788 | B2 | 3/2007 | Augustin | |
| 8,136,741 | B2 | 3/2012 | Hanneke et al. | |
| 2003/0106533 | A1 * | 6/2003 | Crofts et al. | 123/446 |
| 2004/0031863 | A1 | 2/2004 | Potz et al. | |
| 2009/0032622 | A1 * | 2/2009 | Gibson et al. | 239/533.9 |

(Continued)

FOREIGN PATENT DOCUMENTS

| | | | |
|---|---|---|---|
| CN | 1462338 | A | 12/2003 |
| DE | 198 57 244 | A1 | 6/2000 |

(Continued)

OTHER PUBLICATIONS

International Search Report dated Oct. 12, 2012.

*Primary Examiner* — Ryan Reis
(74) *Attorney, Agent, or Firm* — Thomas H. Twomey

(57) ABSTRACT

An injection nozzle for injecting fuel into a combustion chamber of an internal combustion engine comprises a nozzle body having a bore for receiving fuel from a supply line for pressurized fuel, an outlet from the bore for delivering fuel to the combustion chamber, in use, and a valve needle defining a needle axis and being slidable within the bore. The needle comprises a needle guide portion arranged to guide the needle within the bore. The injection nozzle further comprises a restriction within the bore for restricting fuel flow through the bore, and a restrictive element moveable with the needle and located upstream of the needle guide portion. At least a part of a downstream side of the restrictive element comprises a bevelled surface that extends to a peripheral edge of the restrictive element, the bevelled surface being non-perpendicular to the needle axis.

25 Claims, 7 Drawing Sheets

(56) References Cited

U.S. PATENT DOCUMENTS

| | | | | |
|---|---|---|---|---|
| 2010/0038457 | A1* | 2/2010 | Yurtseven | 239/533.9 |
| 2010/0193611 | A1* | 8/2010 | Burger et al. | 239/533.11 |
| 2012/0103308 | A1* | 5/2012 | Hefler et al. | 123/447 |

FOREIGN PATENT DOCUMENTS

| | | | |
|---|---|---|---|
| DE | 10 2007 032 741 | A1 | 1/2009 |
| DE | 10 2009 000 206 | A1 | 7/2010 |
| DE | 10 2009 029 562 | A1 | 2/2011 |
| DE | 10 2009 045 348 | A1 | 4/2011 |
| JP | 2010-174823 | A | 8/2010 |
| JP | 2010-236368 | A | 10/2010 |
| JP | 4608555 | B2 | 1/2011 |
| JP | 4714268 | B2 | 6/2011 |
| WO | 02/084109 | A2 | 10/2002 |

* cited by examiner

INJECTION NOZZLE

CROSS REFERENCE TO RELATED APPLICATIONS

This application is a national stage application under 35 U.S.C. 371 of PCT Application No. PCT/EP2012/067209 having an international filing date of 4 Sep. 2012, which designated the United States, which PCT application claimed the benefit of European Patent Application No. 11180619.6 filed 8 Sep. 2011, the entire disclosure of each of which are hereby incorporated herein by reference.

FIELD OF THE INVENTION

The invention relates to an injection nozzle for use in a fuel injector for injecting fuel into a cylinder of an internal combustion engine. In particular, the invention relates to an injection nozzle arranged to provide improved control of an injector needle.

BACKGROUND TO THE INVENTION

EP 0 844 383 relates to a high pressure fuel injector for an internal combustion engine. The fuel injector has an injection nozzle defining a bore. The bore provides a flow path for high-pressure fuel between a fuel inlet and a plurality of outlets, the fuel being received from a high-pressure fuel supply passage. The fuel injector includes a needle which is slidable within the bore. At the lower end of the bore a needle seating is defined, the needle being engageable with the seating. The outlets are provided downstream of the seating so that, when the needle is engaged with the seating, fuel is prevented from being injected. When the needle is lifted from the seating, fuel is able to flow past the seating through the outlets and into an associated combustion chamber of the engine.

The needle includes at least one downstream-facing thrust surface against which high-pressure fuel in the bore acts to provide a lifting force to the needle. A control chamber is provided in the injection nozzle at an upper end of the needle, so that the upper end of the needle is exposed to fuel pressure in the control chamber. The control chamber receives fuel at high pressure from the supply passage, and is connectable to a low-pressure drain by way of a valve. The valve therefore controls the pressure of fuel in the control chamber, and hence determines the downward closing force acting on the upper end of the needle. In this way, the direction of the net hydraulic force acting on the needle, and hence the opening and closing movement of the valve needle, can be controlled.

A restriction, in the form of a small radial clearance between the valve needle and a portion of the bore, is provided for restricting the flow of fuel through the bore between the fuel inlet and the outlets. The restriction is upstream of the downstream-facing thrust surface. The restriction therefore ensures that, when the needle is open to allow injection and communication between the control chamber and drain is then closed to initiate closing of the needle, the upward force acting on the downstream-facing thrust surface due to fuel pressure in the bore is less than the downward force acting on the upper end of the needle due to fuel pressure in the control chamber. The pressure differential that results from the restriction gives rise to a substantial net closing hydraulic force on the needle, and allows for a fast needle closure to be achieved.

Providing a restriction within a fuel injector in order to generate a pressure drop between the high-pressure fuel supply and the injecting end of the injection nozzle, in an arrangement similar to that described above, is well known. There are various other ways in which a restriction can be provided in order to induce such a pressure drop. For example, the restriction can be provided near an injecting end of the nozzle, or alternatively within the high-pressure fuel passage that supplies the bore, downstream of where the high-pressure fuel passage supplies the control chamber.

U.S. Pat. No. 6,499,467, for example, discloses an arrangement in which the restriction takes the form of an orifice through a piston-type needle guide portion of the valve needle. The needle guide portion is situated near the injecting end of the nozzle and is remote from the control chamber. EP 0 971 118 discloses an arrangement in which the restriction is defined between an annular collar carried on the valve needle and the wall of the bore.

In all of these arrangements, the control chamber and the bore of the injector are fed from the same high-pressure fuel supply passage. However, the restriction ensures that, when needle closure is required, the closing force arising from the fuel pressure in the control chamber is sufficient to overcome the counteracting opening force arising from the fuel pressure in the bore, downstream of the restriction, acting on the downstream-facing thrust surface or surfaces of the needle.

A possible disadvantage of known arrangements such as those described above is that a relatively large drop in pressure occurs across the restriction. In practice this means that the injection pressure is lower than the pressure of fuel supplied to the injector. Hence, energy is wasted pumping the fuel to a higher pressure than is available for injection. It would be desirable to provide an arrangement in which a large pressure drop across a restriction is not required for operation of the injector, so that, for a given fuel supply pressure, a higher injection pressure can be achieved.

A further possible disadvantage of known injectors using restrictions in the aforementioned manner is that, because the bore of the injection nozzle is very small, the machining required to provide accurate radial distances for providing the desired pressure drop has to be very accurate. Such accuracy, particularly on such small scales, means that such injectors are both time consuming and costly to manufacture. It would be desirable to provide an injector which is cheaper and simpler to manufacture.

In these prior art arrangements, the rate of fuel through the restrictions is sensitive to the viscosity, and hence the temperature, of the fuel. In use, the temperature of the fuel varies considerably over the operating phases of the engine, which can result in unpredictable needle behaviour. Accordingly, it would be desirable to provide an injector which is less sensitive to fuel viscosity.

It is therefore an object of embodiments of the invention to at least partially mitigate one or more of the above mentioned problems.

SUMMARY OF THE INVENTION

According to a first aspect of the present invention, there is provided an injection nozzle for injecting fuel into a combustion chamber of an internal combustion engine, the injection nozzle comprising a nozzle body having a bore for receiving fuel from a supply line for pressurised fuel, an outlet from the bore for delivering fuel to the combustion chamber, in use, and a valve needle defining a needle axis and being slidable within the bore between a closed state in which fuel flow through the outlet into the combustion chamber is prevented, and an injecting state in which fuel flow through the outlet into the combustion chamber is enabled. Movement of the needle is controllable by varying the fuel pressure within a control chamber, in use. The needle comprises a needle guide portion arranged to guide sliding movement of the needle within the bore.

The injection nozzle further comprises a restriction within the bore for restricting the flow of fuel through the bore, and a restrictive element having an upstream side and a downstream side. The restrictive element is moveable with the needle and is located upstream of the needle guide portion. The restriction is defined between the bore and a peripheral edge of the restrictive element, and when the needle is in the injecting state in use, the pressure of fuel at the outlet is substantially the same as the pressure of fuel in the bore immediately downstream of the restrictive element and is less than the pressure of fuel supplied to the bore from the supply line.

In this first aspect of the invention, at least a part of the downstream side of the restrictive element comprises a bevelled surface that extends to the peripheral edge of the restrictive element. The bevelled surface is non-perpendicular to the needle axis.

The restrictive element restricts the flow of fuel to provide a pressure drop so that, when the needle is in the injecting state with fuel flowing through the bore, the fuel pressure downstream of the restrictive element is less than the fuel pressure upstream of the restrictive element. In this way, control of the valve needle can be improved by optimising the size of the restriction.

Providing a restrictive element that is moveable with the needle and separate from, or spaced apart from, the guide portion of the needle helps to improve the dynamic characteristics of the needle during opening and closing of the needle. Furthermore, providing the restrictive element upstream of the needle guide portion allows for the needle guide to be arranged as close to the tip of the injector as possible, which increases the mechanical stability of the needle in use.

Since the fuel pressure at the outlet is substantially the same as the fuel pressure immediately downstream of the restrictive element, it will be understood that there is no appreciable pressure drop across the guide portion of the needle. Said another way, any pressure drop that occurs across the guide portion of the needle is minimal in comparison to the pressure drop across the restrictive element.

The bevelled surface on the downstream side of the restrictive element, downstream of the peripheral edge, serves to maximise the turbulence of fuel downstream of the restrictive element as the fuel flows through the restriction. Advantageously, this arrangement reduces the sensitivity to fuel viscosity of the flow characteristics through the restriction, such that the effect of temperature changes on the performance of the injector is minimised.

The downstream side of the restrictive element may comprise a downstream face that is normal to the needle axis, and the bevelled surface may be formed as a chamfer at the periphery of the downstream face. The bevelled surface may be frustoconical.

In one embodiment, the bevelled surface lies at an angle of between approximately 15° and 45° with respect to the needle axis. Preferably, the bevelled surface lies at an angle of approximately 30° with respect to the needle axis.

The upstream side of the restrictive element may comprise an upstream edge face that extends to the peripheral edge of the restrictive element. In one embodiment, for example, the upstream side of the restrictive element comprises a central face, and the upstream edge face is annularly disposed around the central face. The upstream edge face may be recessed from the central face to define a step between the upstream edge face and the central face.

Preferably, the upstream edge face is normal to the needle axis. The peripheral edge of the restrictive element may be defined where the upstream edge face and the bevelled surface meet. In this way, the peripheral edge can take the form of a sharp edge at the intersection between the upstream edge face and the bevelled surface, such that the restriction has fluid flow characteristics approaching those of a theoretical sharp-edged orifice, with minimal sensitivity to viscosity.

In another embodiment, at least a part of the upstream side of the restrictive element comprises a bevelled surface that extends to the peripheral edge, the bevelled surface being non-perpendicular to the needle axis.

In any arrangement according to this first aspect of the invention, it is desirable that the length of the restriction in the flow direction within the bore, and hence the length of the peripheral edge in the direction of the needle axis, is as short as possible. This arrangement minimises the sensitivity of the flow to viscosity, and reduces the moving mass of the valve needle. For example, the peripheral edge may have a length of approximately 0.2 mm or less in a direction parallel to the needle axis. Preferably, the peripheral edge has a length of approximately 0.1 mm or less in the direction parallel to the needle axis. The peripheral edge may comprise a generally cylindrical surface that extends parallel to the needle axis. Instead of a generally cylindrical surface, the peripheral edge may comprise a curved or barrelled surface or may be formed with knife-edge geometry.

The length of a join region or interface between the collar and the shaft can be relatively long in the needle axis direction, compared to the length of the peripheral edge, to maximise the mechanical strength of the assembly.

The injection nozzle may comprise a first bore volume upstream of the restriction and arranged to receive fuel from the supply line, and a second bore volume downstream of the restriction and arranged to receive fuel from the first bore volume through the restriction. The needle guide portion of the needle is preferably disposed within the second bore volume.

The restrictive element may comprise an upstream-facing thrust surface which is exposed to fuel pressure in the first bore volume in use. Advantageously, in this arrangement, when the valve needle is in the injecting state, the upstream-facing thrust surface of the restrictive element applies an additional component of force to the valve needle that acts in a closing direction.

In this way, when the needle is caused to move from the injecting state to the closed state by a change in pressure in the control chamber, the pressure acting on the upstream-facing thrust surface of the restrictive element serves to assist closing movement of the needle, resulting in a faster needle closure speed. In contrast, when the needle is caused to move from the closed state to the injecting state by a change in pressure in the control chamber, the pressure acting on the upstream-facing thrust surface of the restrictive element serves to reduce the net opening force on the needle during opening, resulting in damping of the needle opening movement and therefore a slower needle opening speed. Both a faster needle closure speed and a slower needle opening speed are advantageous in improving injection control.

In one embodiment, the needle comprises at least one downstream-facing thrust surface which is exposed to fuel pressure downstream of the restriction in use. Preferably, the downstream-facing thrust surface is exposed to fuel pressure in the second bore volume in use. Fuel pressure in the second bore volume acts to apply a component of force to the valve needle that acts in the needle opening direction. Since the pressure of fuel in the second bore volume is controlled by the restriction, the force that arises from the downstream-facing thrust surface can be selected to optimise operation of the injector by selecting the size of the restriction.

The restrictive element may take any suitable form, and may be formed integrally with the needle or formed as a separate component that is subsequently attached to the needle during manufacture.

For instance, the needle may include a shaft portion, and the restrictive element may comprise a collar disposed annularly around the shaft portion. The collar may be integrally formed with the shaft portion or, alternatively, the collar may be a separate component press-fitted or otherwise attached to the shaft portion. When the restrictive element is a separate component to the needle, the material wastage in constructing the needle by grinding can be reduced.

The thickness or length of the collar along the axis of the needle may be substantially less than the diameter of the collar. In this way, the moving mass of the needle can be reduced. The needle may include a stem portion having a smaller diameter than the shaft portion, again to reduce the moving mass of the needle. The stem portion may be upstream of the shaft portion.

Preferably, the collar has a larger diameter than the needle guide portion of the needle. The injection nozzle may further comprise a control piston associated with the needle and having a control surface exposed to fuel pressure within the control chamber. In this case, the collar may have a larger diameter than the piston. When the collar has a larger diameter than the needle guide portion and/or the control piston, the collar is particularly effective in both damping the opening movement of the needle and assisting the closing movement of the needle.

The bore may include a region of relatively large diameter and a region of relatively small diameter. The relatively small-diameter region may be provided downstream of the relatively large-diameter region.

The restrictive element may be located within the relatively large-diameter region of the bore. By providing the restrictive element in the large-diameter region of the bore, a restrictive element with a large cross-sectional area, perpendicular to the direction of needle movement, can be provided. In particular, when the restrictive element comprises an upstream-facing thrust surface, the cross-sectional area of the thrust surface which is exposed to fuel pressure in the bore upstream of the restrictive element can be relatively large in this arrangement. Having a large cross-sectional area, in turn, improves the opening and closing characteristics of the needle. Furthermore, providing a restrictive element with a large cross-sectional area allows for a lower pressure drop to be provided across the restrictive element in order to provide the same needle closing force, thereby increasing the available injection pressure and reducing the effect of manufacturing tolerances.

The restrictive element is preferably disposed at a downstream end portion of the region of relatively large diameter. For example, the restrictive element may be disposed in a downstream third of the region of relatively large diameter or, more preferably, in a downstream quarter of the region of relatively large diameter.

In another arrangement, the bore includes a region of relatively large diameter upstream of the restrictive element, a region of relatively small diameter in which the needle guide portion of the valve needle is disposed, and a region of intermediate diameter in which the restrictive element is disposed.

By locating the restrictive element at a downstream end portion of the region of relatively large diameter, or in an intermediate-diameter region downstream of the region of relatively large diameter, the volume of the bore above the restrictive element is maximised and the volume below it is minimised. This helps to maximise the accumulator volume available for high-pressure fuel in the large-diameter region of the bore, upstream of the restriction.

The needle guide portion may be provided in the region of relatively small diameter. The outlets may be provided in the relatively small-diameter region of the bore. Hence, the needle guide portion can be disposed close to the outlets at the nozzle tip. Providing the needle guide portion near to the nozzle tip provides support for the needle and helps to prevent movement of the needle near the tip of the nozzle.

When the restrictive element is a collar or a similar generally cylindrical component, the diameter of the restrictive element may be approximately twice the diameter of the relatively small-diameter region of the bore. This provides conditions in which, during closure of the needle, the needle moves at a speed approximately equal to the speed of fuel flow through the bore of the injection nozzle. As such, a fast needle closure is achieved.

The restrictive element can be provided with a plurality of annular protrusions. In this case, the restriction may comprise, at least in part, a series of sub-restrictions, with each sub-restriction being defined between the outer periphery of a respective one of the protrusions and the bore. In this case, therefore, each of the protrusions causes a reduction in fuel pressure across the restrictive element, and the total pressure drop across the restrictive element is the cumulative sum of the pressure drop across each protrusion. By providing a series of sub-restrictions, each generating a relatively small pressure drop, the accuracy and tolerances required for defining the restriction are reduced compared to an arrangement in which the pressure drop is achieved through a single restriction. The downstream side of one or more of the annular protrusions may comprise a bevelled surface which is inclined to the needle axis.

In use of the injection nozzle, pressure waves can arise in the fuel within the bore. Such pressure waves have characteristic wavelengths that depend on the geometry of the bore. Such waves are undesirable because they can disturb the opening and closing movement of the needle and the pressure of injected fuel, giving rise to uncertainty in the quantity of fuel injected. Advantageously, the restrictive element can be arranged on the needle so that, in use, it is positioned at or close to an antinode of one or more such pressure waves, thereby damping the waves and reducing their undesirable effect. For example, the restrictive element may be positioned at an antinode of a characteristic standing wave in the bore.

The restriction can be manufactured by grinding down the restrictive element to a suitable size with respect to the size of the bore. This arrangement provides for a simplified manufacturing process.

The injection nozzle may further comprise a spring for urging the needle towards the closed position. The spring can be arranged to engage with an upper surface of the restrictive element. Alternatively, the needle may comprise a spring seat that is spaced from and disposed upstream of the restrictive element. To enable the injection nozzle to operate at low pressures, a relatively low-load spring may be required, and providing a separate spring seat upstream of the restrictive element allows a relatively short low-load spring to be used to minimise the risk of buckling. Furthermore, in this arrangement, the volume of the bore upstream of the restrictive element that is occupied by the spring is relatively low, maximising the volume available for fuel.

A spacer element may be disposed within the bore. The spacer element may comprise a bore for receiving an upstream end of the needle, and an upstream end of the spring may bear against a downstream face of the spacer element.

The injection nozzle may comprise a plurality of restrictive elements spaced apart along the needle. Providing a plurality of restrictive elements will assist in further damping oscillations within fuel within the bore. Furthermore, if a plurality of restrictive elements are provided the pressure drop required across each restrictive element can be reduced, so that the total required pressure drop is divided between the plurality of restrictive elements. One advantage of this arrangement is that the effect of manufacturing tolerances on the total flow restriction is reduced.

The restrictive element may provide an upper surface arranged to resist movement of the valve needle from the closed position to the open position. This resistance is due to the valve needle, and hence the restrictive element, moving against the flow of fuel from the supply line to the outlet. The upper surface of the restrictive element may also assist movement of the valve needle from the open position to the closed position when the valve needle is moving with the flow of fuel from the supply line to the outlet. The surface area of the upper surface of the restrictive element therefore assists in the movement characteristics of the needle. In particular, the upper surface area slows down the opening of the needle by providing resistance against the flow of fuel, which is in the opposite direction to the needle movement. Furthermore, the surface area of the upper surface of the restrictive element helps to provide a fast needle closure because the flow of fuel exerts a downward force on the upper surface of the restrictive element.

The speed and acceleration of the needle during its opening and closing movement is determined by several factors, including the hydraulic forces acting on the needle, the strength of any biasing spring, and the mass of the needle. In embodiments of the present invention, the restrictive element can also influence the dynamics of needle movement by introducing a drag component to the movement of the needle.

In general terms, the restrictive element is preferably dimensioned such that, when the valve needle is in the injecting state in use, the flow rate of fuel in the bore, particularly in the vicinity of the restrictive element, is approximately equal to the rate at which the valve needle moves during movement of the valve needle from the injecting state to the closed state. Because the needle moves at the approximately the same speed as the fuel in the bore, drag on the needle, due to the presence of the restrictive element, is thereby minimised during closing needle movement.

The restrictive element may have a cross-sectional area, perpendicular to the direction of movement of the needle, which is approximately 200 to 800 times larger than the total cross-sectional area of the outlets. The speed of the flow of fuel through the bore is determined in accordance with the area of the outlet. When the restrictive element includes an upstream-facing thrust surface, the closing speed of the needle is influenced by the cross-sectional area of the upstream-facing thrust surface and the speed of the fuel within the bore. Hence, the speed of needle closure can be influenced by the ratio of the cross-sectional area of the restrictive element with respect to the area of the outlet. It is, in particular, the cross-sectional area of the upper surface of the restrictive element perpendicular to the direction of movement of the needle that influences the speed of needle closure in this embodiment of the invention. The above-mentioned ratios of restrictive element area to outlet area are provided in order to optimise the needle closing speed.

Preferably, the restrictive element has a cross-sectional area perpendicular to the direction of movement of the needle that is approximately 500 times larger than the cross-sectional area of the outlet. Such a ratio of restrictive element area to outlet area allows for the needle closing speed to be approximately equal to the speed of fuel flow.

According to a second aspect of the present invention, there is provided an injection nozzle for injecting fuel into a combustion chamber of an internal combustion engine. The injection nozzle comprises a nozzle body having a bore for receiving fuel from a supply line for pressurised fuel. An outlet is provided from the bore for delivering fuel to the combustion chamber, in use. In addition, a valve needle is provided, which is slidable within the bore between a closed state in which fuel flow through the outlet into the combustion chamber is prevented, and an injecting state in which fuel flow through the outlet into the combustion chamber is enabled. Movement of the needle is controllable by varying the fuel pressure within a control chamber, in use.

The needle comprises a needle guide portion arranged to guide movement of the needle within the bore. The injection nozzle further comprises a restriction within the bore for restricting the flow of fuel through the bore. The restriction is defined by a restrictive element which is moveable with the needle and located upstream of the needle guide portion. The fuel pressure at the outlet is substantially the same as the fuel pressure in the bore immediately downstream of the restrictive element and is less than the pressure of fuel supplied to the bore from the supply line.

The restriction may be defined, at least in part, between the restrictive element and the bore. The restriction may be of generally annular form. For example, the restrictive element may be defined, at least in part, between the outer periphery, or an outer circumferential surface of the restrictive element and the bore.

The restrictive element can be provided with at least one flat region on an outer surface thereof. The restriction can be defined, at least in part, between the flat region and the bore. Conveniently, in this embodiment, the restriction can be defined during manufacture by grinding a flat surface onto a restrictive element of a needle. Similarly, the restriction could be defined, at least in part, by one or more channels, grooves, slots or similar features in the restrictive element.

The bore may be provided with at least one recess, in which case the restriction can be defined, at least in part, by an outer surface of the restrictive element and the or each recess.

The restrictive element can be provided with one or more orifices to at least partly define the restriction. The or each orifice can be provided by drilling a hole through the restrictive element. Using such a method, the restrictive element is relatively easy to manufacture since such drillings can be formed with accurate dimensions.

In some embodiments of this aspect of the invention, the restrictive element is not in contact with the wall of the bore, and therefore the restrictive element does not perform a guiding function for movement of the needle. In other embodiments, the restrictive element is in sliding contact with the bore, and therefore helps to guide linear movement of the needle.

According to a third aspect of the invention, there is provided an injection nozzle for injecting fuel into a combustion chamber of an internal combustion engine. The injection nozzle comprises a nozzle body having bore for receiving fuel from a supply line for pressurised fuel. An outlet is provided from the bore for delivering fuel to the combustion chamber, in use. In addition, a valve needle is provided, which is slidable within the bore between a closed state in which fuel flow through the outlet into the combustion chamber is prevented, and an injecting state in which fuel flow through the outlet into the combustion chamber is enabled. Movement of the needle is controllable by varying the fuel pressure within a control chamber, in use.

In this third aspect of the invention, the injection nozzle further comprises a restriction within the bore for restricting the flow of fuel through the bore, and a restrictive element which is moveable with the needle. The restriction is defined between the restrictive element and the bore. The restrictive element comprises an upstream-facing thrust surface which is exposed to fuel pressure upstream of the restriction, in use. The fuel pressure at the outlet is substantially the same as the fuel pressure in the bore immediately downstream of the restrictive element and is less than the pressure of fuel supplied to the bore from the supply line.

In another aspect of the invention, there is provided an injection nozzle for injecting fuel into a combustion chamber of an internal combustion engine, the injection nozzle comprising a nozzle body having a bore for receiving fuel from a supply line for pressurised fuel, an outlet from the bore for delivering fuel to the combustion chamber, in use, and a valve needle defining a needle axis and being slidable within the bore between a closed state in which fuel flow through the outlet into the combustion chamber is prevented, and an injecting state in which fuel flow through the outlet into the combustion chamber is enabled. Movement of the needle is controllable by varying the fuel pressure within a control chamber, in use. The injection nozzle further comprises a restriction within the bore for restricting the flow of fuel through the bore, and a restrictive element having an upstream side and a downstream side. The restrictive element is moveable with the needle. The restriction is defined between the bore and a peripheral edge of the restrictive element. At least a part of the downstream side of the restrictive element comprises a bevelled surface that extends to the peripheral edge of the restrictive element.

In a further aspect of the present invention, an injection nozzle for injecting fuel into a combustion chamber of an internal combustion engine is provided. The injection nozzle comprises a nozzle body having a bore for receiving fuel from a supply line for pressurised fuel. An outlet is provided from the bore for delivering fuel to the combustion chamber, in use. In addition, a valve needle is provided, which is slidable within the bore between a closed state in which fuel flow through the outlet into the combustion chamber is prevented, and an injecting state in which fuel flow through the outlet into the combustion chamber is enabled.

Movement of the needle is controllable by varying the fuel pressure within a control chamber, in use. The needle comprises a needle guide portion arranged to guide movement of the needle within the bore. The injection nozzle further comprises a restriction within the bore for restricting the flow of fuel through the bore. The restriction is defined by one or more restrictive elements which are moveable with the needle and located upstream of the needle guide portion. The restriction comprises a series of sub-restrictions. In one arrangement, two or more restrictive elements are spaced apart along the valve needle, and each sub-restriction is defined by a respective one of the restrictive elements. In another arrangement, the or each restrictive element is provided with a plurality of annular protrusions, and each sub-restriction is defined by a respective one of the annular protrusions. In a further arrangement, two or more restrictive elements are spaced apart along the valve needle, and each restrictive element includes a plurality of annular protrusions.

Embodiments of the present invention provide reduced pressure drops across the restriction, between the high pressure fuel supply passage and the injecting end of the nozzle, compared to the prior art, whilst also providing fast needle closure. This in turn reduces the pressure to which fuel needs to be pumped and therefore reduces the energy consumption of such fuel injection systems. This can be achieved in the present invention by providing the restriction between the restrictive element associated with the needle and a relatively large-diameter region of the injector bore, upstream of the thrust surface. This arrangement allows for the restrictive element to have a relatively large cross-sectional area and thereby provide a comparatively small pressure drop across it.

Embodiments of the present invention reduce the manufacturing complexity of an injector compared to known injectors. In particular, as the restriction can be defined within a relatively large-diameter region of the bore of the injection nozzle, the restrictive element can have a relatively large diameter compared to the diameter of the needle, and in turn a restriction with a larger flow area can be provided. It is therefore simpler and cheaper to manufacture such an injector compared with known injectors of the aforementioned type.

Embodiments of the present invention provide improved needle closure due to the large cross-sectional area of the restrictive element which helps the needle to close at the speed of the fuel flowing through the bore.

Embodiments of the present invention provide damped needle opening. An upstream-facing thrust surface of a restrictive element associated with the needle provides a resistance against the flow of fuel, which is flowing in a direction opposite to the direction that the needle is attempting to move during opening. This resistance therefore slows the opening of the needle, which is desirable.

Embodiments of the present invention help to reduce oscillations in the fuel within the bore of the injection nozzle. In particular, a restrictive element within the bore dampens the oscillations in the fuel within said bore. Damping of oscillations in the fuel therefore reduces the effect that such oscillations have on the needle due to the fuel oscillations being transferred to the needle. In yet further embodiments of the invention, the presence of a plurality of restrictive elements helps to reduce the oscillations further.

It will be appreciated that preferred and/or optional features of each aspect of the invention can also be included in the other aspects of the invention, alone or in appropriate combination.

BRIEF DESCRIPTION OF THE DRAWINGS

Embodiments of the present invention will now be described, by way of example only, with reference to the accompanying drawings, in which like reference numerals refer to like parts, and in which:

FIG. 1(*b*) is an enlarged cross-section of the injection nozzle of FIG. 1(*a*);

FIG. 3(*b*) is an enlarged cross-section of the injection nozzle of FIG. 3(*a*);

Figure 1A:
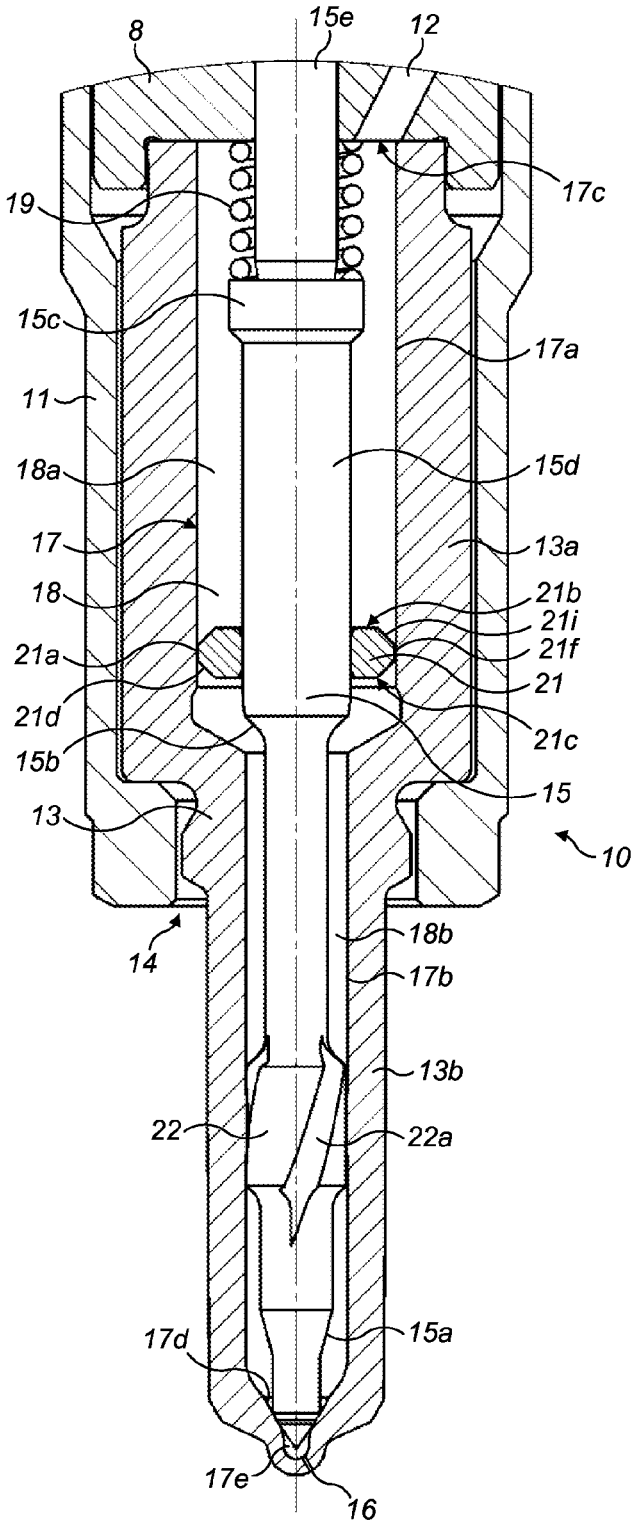
FIG. 1(*a*) is a cross-section of an injection nozzle in accordance with a first embodiment of the present invention.
Figure 1B:
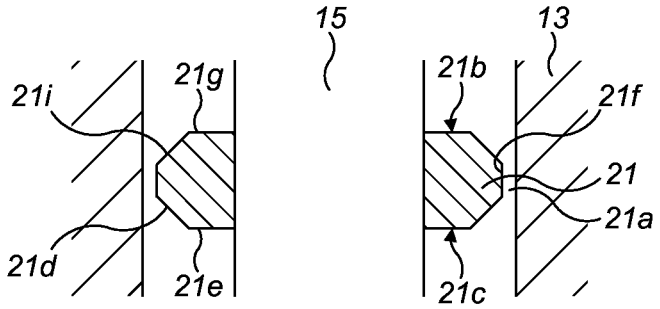
Figure 2:
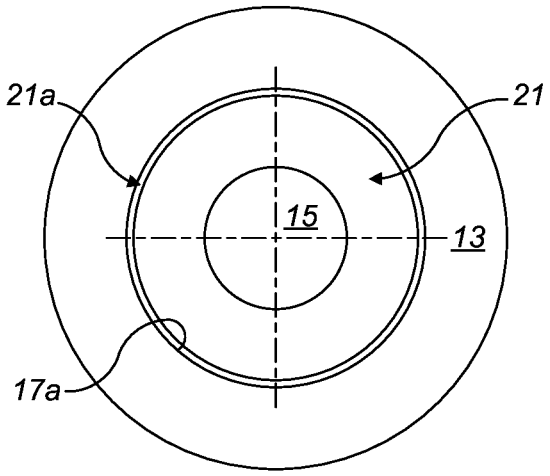
FIG. 2 is a cross-sectional plan view of part of the injection nozzle of FIG. 1.

Throughout this specification, terms such as 'upper' and 'lower' are used with reference to the orientation of the injection nozzle as shown in FIGS. 1(*a*), 1(*b*), 3(*a*), 3(*b*) and 9, although it will be appreciated that the injection nozzle could be used in any suitable orientation. Terms such as 'upstream' and 'downstream' refer to the general direction of fuel flow within the injection nozzle during injection in normal use (i.e. downwards in FIGS. 1(*a*), 1(*b*), 3(*a*), 3(*b*) and 9).

DETAILED DESCRIPTION OF EMBODIMENTS OF THE INVENTION

FIGS. 1(*a*) and 1(*b*) show an injection nozzle 10 according to a first embodiment of the invention. The injection nozzle 10 forms part of a fuel injector for injecting fuel into a combustion chamber (not shown) of an associated engine. Referring to FIG. 1(*a*), the injection nozzle 10 is provided with a valve needle 15 that is slidable within a bore 17 of a nozzle body 13 of the injection nozzle 10. An upper portion of the nozzle body 13 is received within a recess in a housing part 8. The housing part 8 and the nozzle body 13 are received, at least in part, within an injector housing in the form of a cap nut 11.

An upper end of the bore 17 receives high-pressure fuel, in use, from a high-pressure fuel supply passage 12 defined, at least in part, within the housing part 8. The valve needle 15 is provided with first and second thrust surfaces 15*a*, 15*b* of generally frusto-conical form that are exposed to fuel pressure within the bore 17.

At a lower end of the bore 17, the bore defines a valve needle seating 17*d* of frusto-conical form with which the needle 15 is engageable. Downstream of the seating 17*d* the nozzle body 13 is provided with a plurality of outlets 16 (only one of which is shown) in communication with a sac volume 17*e* defined in the lowermost tip of the bore 17. The outlets 16 permit high-pressure fuel within the bore 17 to be injected into a combustion chamber (not shown) of an associated engine. When the needle 15 is engaged with the seating 17*d*, fuel is prevented from being injected from the injection nozzle 10. In this case, the needle can be said to be in a closed state. When the needle 15 lifts away from the seating 17*d*, and the tip of the needle 15 disengages from the seating 17*d*, fuel is injected into the combustion chamber through the outlets 16. In this condition, the needle can be said to be in an injecting state.

A restrictive pressure reduction element in the form of a collar 21 is provided on the needle 15. The collar 21 is carried on a cylindrical shaft portion 15*d* of the needle 15. As will be explained in more detail below, when the needle 15 is lifted from the seating 17*d* in use, the collar 21 gives rise to a pressure drop in the fuel flow path through the bore between the high pressure supply passage 12 and the outlets 16. The collar 21 protrudes radially outwards from the needle and has a relatively large cross-sectional area in comparison with the diameter of the needle 15.

At an upper end of the bore 17, a spring 19 is provided to urge the needle towards the closed state. The spring 19 is engaged between the upper surface of a spring support collar 15*c* of the needle 15 and the lower surface of the housing part 8. The spring support collar 15*c* thus provides a spring seat for the spring 19 and is formed as an integral part of the needle 15 in the illustrated embodiment, although it could instead be a separate part mounted on the needle 15.

Movement of the valve needle is controlled by varying fuel pressure within a control chamber (not shown) located within the housing part 8. The valve needle 15 includes, at its upstream end, a control piston 15*e* (only a lower part of which is shown in FIG. 1(*a*)). The end of the control piston 15*e* is received in the control chamber, such that an end surface of the control piston 15*e* is exposed to fuel pressure in the control chamber.

Fuel pressure within the control chamber is controlled by means of an actuation system (not shown) which will be familiar to those skilled in the art. For example, the actuation system may include a three-way valve which controls whether fuel flows from the high-pressure fuel supply passage 12 to the control chamber whilst fuel flow between the control chamber and a low pressure drain is prevented, or whether fuel can flow from the control chamber to the low pressure drain and fuel flow from the high-pressure fuel supply passage 12 to the control chamber is prevented. The operation of the valve is controlled, for example, by means of a solenoid or piezoelectric actuator.

The nozzle body 13 has two distinct parts, namely a large-diameter region 13*a* in an upstream portion of the injection nozzle 10 and a small-diameter region 13*b* in a downstream portion of the injection nozzle 10. The large-diameter region 13*a* is located within the cap nut 11, while the small-diameter region 13*a* is arranged to protrude through an opening 14 in the cap nut 11.

The outlets 16 are disposed at the end of the small-diameter region 13*b* of the nozzle body 13. The outlets 16 are arranged at the tip of the small-diameter region 13*b* of the nozzle body 13, which is located, in use, within the combustion chamber of the associated engine (not shown).

The bore 17 of the nozzle body 13 takes substantially the same form as the nozzle body 13; therefore the bore 17 is formed of a large-diameter region 17*a*, and a small-diameter region 17*b*. The needle 15 runs co-axially through both the large and small-diameter regions 17*a*, 17*b* of the bore 17.

Fuel enters the bore 17 from the high-pressure fuel supply passage 12 through a fuel inlet 17*c* provided at an upper end of the large-diameter region 17*a* of the bore 17. The bore 17 defines a flow path for fuel from the fuel inlet 17*c*, through the large-diameter region 17*a* of the bore and into the small-diameter region 17*b* of the bore, and towards the outlets 16. In use, fuel fills both the large-diameter region 17*a* and small-diameter region 17*b* of the bore 17, which together define an accumulator volume 18 for fuel.

In the small-diameter region 17*b* of the bore, the valve needle 15 is provided with a needle guide portion 22. The needle guide portion 22 provides a generally cylindrical guiding surface that is arranged to slidingly engage with the inside surface of the small-diameter region 17*b* of the bore, so that lateral movement of the needle 15 within the bore 17 is prevented. The needle guide portion 22 therefore guides the sliding movement of the needle 15 within the bore 17. The needle guide portion 22 has a plurality of angular or helical grooves 22*a* that allow fuel to easily pass the needle guide portion 22 along the aforementioned flow path while still providing the guiding functionality for the needle 15.

It will be appreciated that the presence of the grooves 22*a* in the needle guide portion 22 means that there is substantially no restrictive effect on fuel flow past the needle guide portion 22. As such, the needle guide portion 22 does not provide a reduction in fuel pressure within the bore 17. In alternative embodiments of the invention, a reduction in fuel pressure provided by the needle guide portion 22 is negligible relative to the reduction in fuel pressure provided by the restrictive element 21. Hence, the pressure of fuel that is injected at the outlets 16 is substantially equal to the pressure immediately downstream of the collar 21.

The needle guide portion 22 is arranged within the small-diameter region 17*b* of the bore in order to provide good stability to the tip of the needle 15. It is preferable to provide the needle guide portion 22 as close to the tip of the needle 15 as possible so that the tip of the needle 15 is only able to move along the axis of the needle 15, and not perpendicular to the needle axis. Restricting such lateral movement of the tip of the needle 15 ensures that the tip of the needle 15 forms a reliable seal with the seating 17*d* when the needle is closed.

The collar 21 is provided on the needle 15 in the large-diameter region 17*a* of the bore. The collar 21 is annular in form and has a diameter slightly smaller than that of the large-diameter region 17*a* of the bore, as shown most clearly in FIGS. 1(*b*) and 2. The collar 21 is therefore arranged to define, together with the adjacent region 17*a* of the bore, a restriction 21*a* for restricting the flow of fuel along the fuel flow path between the fuel inlet 17*c* and the outlets 16. The restriction 21*a* is defined around the outer peripheral edge 21*f* of the collar 21, between the collar 21 and the inside surface of the large-diameter region 17*a* of the bore 17. Hence, the restriction 21*a* takes the form of an annular passage or clearance. As will be explained below, the restriction 21*a* is sufficiently small in cross-sectional area to result in a pressure drop across the collar 21 when the needle 15 is in the injecting state and fuel is flowing through the bore. In this way, when the needle is in the injecting state, a reduced fuel pressure is present downstream of the collar 21 compared to that upstream.

The collar 21 therefore divides the accumulator volume 18 into two separate pressure control volumes, referred to hereafter as bore volumes. Referring back to FIG. 1(*a*), a first or upper bore volume 18*a* is formed between a top end of the bore 17 and the collar 21, and a second or lower bore volume 18*b* is formed between the collar 21 and the seating 17*d*. When the needle 15 is in the injecting state, the fuel pressure in the first bore volume 18*a* is greater than the fuel pressure in the second bore volume 18*b*, by virtue of the restriction 21*a*.

The thrust surfaces 15*a*, 15*b* of the needle 15 are located within the second bore volume 18*b*, and are therefore exposed to the reduced fuel pressure when the needle 15 is in the injecting state in use. The needle guide portion 22 is also located within the second bore volume 18*b*, and therefore has the reduced pressure fuel acting on all of its exposed surfaces.

The operation of the injection nozzle 10 in accordance with this first embodiment of the present invention shall now be described with reference to FIGS. 1(*a*), 1(*b*) and 2.

With the needle 15 in the closed state, the tip of the needle 15 is engaged with the seating 17*d* in order to prevent flow of fuel out of the outlets 16. In this state, high-pressure fuel fills the large and small-diameter regions of the bore 17*a*, 17*b*. Since there is no fuel flow, the pressure within the first and second bore volumes 18*a*, 18*b*, either side of the collar 21, is identical. At this stage, communication between the control chamber and drain is closed, so that the fuel pressure in the control chamber is high.

Accordingly, the combined downward or closing force acting on the needle 15 due to fuel pressure in the control chamber acting on the control piston 15*e* and the downward force provided by the spring 19 is greater than the upward or opening force acting on the needle 15 due to the pressure of fuel acting on the thrust surfaces 15*a*, 15*b* of the needle 15. This results in a net downward or closing force on the needle 15, and for this reason the needle 15 remains in the closed position. Because the fuel pressure within the first and second bore volumes 18*a*, 18*b* is the same, the upward and downward forces acting on the collar 21 due to the fuel pressure in the respective volumes cancel one other out.

In order to open the needle 15, the valve is operated to open the connection between the control chamber and the low-pressure drain, thereby reducing the pressure within the control chamber. As the pressure in the control chamber reduces, the resulting downward force acting on the control piston 15*e* decreases, and eventually a point is reached at which the upward force exerted on the thrust surfaces 15*a*, 15*b* of the needle 15 due to fuel pressure within the second bore volume 18*b* is larger than the downward force acting on the needle 15 due to fuel pressure within the control chamber combined with the downward force due to the spring 19. At this point, a net upward or opening force acts on the needle 15, and the needle 15 begins to move upwards away from the seat 17*d* to enter its injecting state.

As the needle 15 lifts off the seat 17*d*, fuel begins to flow out from the outlets 16 and into the combustion chamber. While the high-pressure fuel passage 12 continues to supply fuel to the bore 17, the pressure at the lower end of the bore 17, in the second bore volume 18*b*, reduces due to fuel being injected into the combustion chamber. This helps to slow the initial speed at which the needle 15 lifts because the upward pressure exerted by the fuel on the thrust surfaces 15*a*, 15*b* reduces.

Furthermore, because fuel flows into the second bore volume 18*b* past the collar 21 and therefore through the restriction 21*a*, the fuel pressure in the second bore volume 18*b* is reduced compared to the fuel pressure in the first bore volume 18*a*. As a result, the fuel pressure acting on each side of the collar 21 is no longer balanced, and instead the collar applies a downward force on the needle 15. Said another way, the upstream-facing side 21*b* of the collar 21 forms an upstream-facing thrust surface which is exposed to fuel pressure in the first bore volume 18*a* to produce a downward component of force on the needle 15.

Accordingly, as fuel flows through the bore 17, it applies a pressure against the upstream-facing side 21*b* of the collar 21 and as such also helps to reduce the speed at which the needle 15 moves upwards away from the seating 17*d*. In addition, the movement of the collar 21 through the fuel gives rise to a drag effect that also attenuates the speed of the needle 15. Hence, the collar 21 has the effect of damping the opening movement of the needle 15 against the flow of fuel in the opposite direction to the movement of the needle 15. It is noted that the downward component of force acting on the needle 15 through the collar 21 is not sufficient to overcome the upward components of force acting through the thrust surfaces 15*a*, 15*b*, so a net upward force continues to act to open the needle 15.

The needle 15 eventually reaches a maximum lift position, and fuel continues to flow from the high-pressure fuel passage 12 through the bore 17 and through the outlets 16 into the combustion chamber.

When the desired amount of fuel has been delivered to the combustion chamber, the valve is operated to close the connection to drain and to allow high-pressure fuel to flow into the control chamber. The pressure in the control chamber increases, so that the downward or closing force acting on the needle 15 through the control piston 15*e* rises. Eventually, the combined downward forces acting on the needle 15 become larger than the upward forces acting on the needle 15, resulting in a net downward force on the needle that causes the needle to move in a closing direction.

As previously noted, since the restriction 21*a* provides a pressure drop across the collar 21, a higher pressure is present in the first bore volume 18*a* than is present in the second bore volume 18*b* downstream of the collar 21. The resulting downward force applied to the needle 15 through the collar 21 by the pressure of fuel acting on the upstream-facing thrust surface 21*b* provides an additional component of closing force that increases the speed of needle closure.

Advantageously, the collar 21 and the restriction 21*a* are dimensioned so that the flow rate of fuel in the region of the collar 21 is approximately the same as the speed at which the needle moves during closure. In this arrangement, there is little or no relative movement between the collar 21 and the fuel surrounding the collar 21 during needle closure, such that little or no drag arises. Hence, the collar 21 provides a closing thrust surface to enable the needle 15 to "go with the flow of fuel" within the bore 17. In other words, the collar 21 does not damp closing movement of the needle, but instead allows fast needle closure. Fast needle closure is desirable in order to minimise smoke and to reduce unwanted $CO_2$ emissions.

The closing operation finishes when the needle 15 engages with the seating and prevents further fuel flow out of the outlets 16 until a further opening operation is carried out.

It will be appreciated that the effect of the restrictive element or collar 21 on the movement of the needle 15 exhibits hysteresis. During needle opening, the collar 21 damps movement of the needle, allowing good control of small injection volumes. During needle closing, the collar 21 boosts the closing speed of the needle, which allows rapid termination of injection. The additional force applied to the needle 15 by the collar 21 also helps to damp out any mechanical oscillations in the needle movement due to force waves travelling through the length of the needle 15 in use.

The diameter of the collar 21 in this embodiment of the invention is approximately twice the diameter of the needle guide portion 22 or, equivalently, the small-diameter region 17*b* of the bore 17. When disposed in the large-diameter region 17*a* of the bore, the collar 21 will therefore typically have a cross-sectional area four times larger than if it were disposed in the small-diameter region 17*b*, for example in place of the needle guide portion 22. Since the additional needle closing force generated by the collar 21 depends on the cross-sectional area of the collar exposed to fuel pressure in the first bore volume 18*a* multiplied by the pressure difference across the collar 21, a significantly smaller pressure drop (four times smaller, in this example) can be used to generate a given additional needle closing force. Therefore, a higher injection pressure can be achieved for a given fuel supply pressure, increasing efficiency.

A further advantage of defining the restriction 21*a* in the large-diameter region 17*a* of the bore 17 is that the process of defining the restriction 21*a* during manufacture, and the manufacture of the injection nozzle as a whole, is simplified compared to known arrangements. As mentioned above, since the collar 21 has a relatively large cross-sectional area, the pressure drop required at the restriction 21*a* is relatively small. The restriction 21*a* therefore requires a relatively large cross-sectional area available for fuel flow. In other words, the radial gap between the collar 21 and the bore 17 is larger in the illustrated embodiment than if the collar 21 were positioned in a smaller-diameter region of the bore. Accordingly, the cross-sectional area available for fuel flow through the restriction is less sensitive to small variations in the diameter of the collar 21 and the bore 17 due to manufacturing tolerances.

The length or thickness of the collar 21, taken in a direction parallel to the axis of the needle 15, is relatively small compared to the diameter of the collar 21. A thin collar 21 is preferable for reducing the mass of the collar 21, and therefore the moving mass of the needle 15. Since the collar 21 does not guide the sliding movement of the needle 15, there is no requirement for the collar 21 to extend axially along the length of the needle 15.

As shown most clearly in FIG. 1(*b*), the collar 21 is provided with a chamfered or bevelled edge portion 21*i*, 21*d*, on both its upstream-facing and downstream-facing sides 21*b*, 21*c*. The chamfered edge portions 21*i*, 21*d* extend from respective upper and lower faces 21*g*, 21*e* of the collar 21 to the outer peripheral edge 21*f*. The upper and lower faces 21*g*, 21*e* lie normal to the axis of the needle 15.

The chamfered portions 21*i*, 21*d* enable the peripheral surface of the collar 21 that defines the restriction to be short in length, while the internal surface of the collar 21 that abuts the shaft portion 15*d* of the needle 15 is comparatively long to permit secure engagement of the collar 21 on the shaft portion 15*d*. Keeping the peripheral surface short means that the restriction 21*a* behaves like an orifice, which reduces the effect of fuel viscosity on the fuel flow behaviour in the restriction 21*a*. In particular, the chamfered edge portion 21*d* of the collar 21, downstream of the peripheral edge 21*f*, serves to maximise the turbulence of fuel downstream of the collar 21 as the fuel flows through the restriction 21*a*.

The chamfered portions 21*i*, 21*d* also help to minimise the volume and mass of the collar 21 without compromising the strength of the collar 21. The chamfered portions 21*i*, 21*d* also aid the dynamic properties of the collar 21 in use, and reduce the burr that tends to be generated when grinding the diameter of the collar 21 to size during manufacture of the injection nozzle 10.

In this first embodiment of the present invention, the collar 21 is a component of the injection nozzle 10 separate to the needle 15. The collar 21 is arranged to be press-fitted to the shaft portion 15*a* of the needle 15, so that the collar 21 is not moveable with respect to the needle 15. The collar 21 therefore moves with the needle 15 as the needle 15 slides within the bore 17. One advantage of making the collar 21 separately from the needle is that the bar size required for manufacturing the needle can be reduced, thereby reducing manufacturing cost and waste material during manufacture. However, it will be appreciated that in alternative embodiments of the invention the collar 21 could be an integral feature of the needle.

In order to maximise the accuracy with which the cross-section of the restriction 21*a* is formed it can be desirable to grind the diameter of the collar 21 after fixation of the collar 21 to the needle 15. In particular, grinding the diameter of the collar 21 when the collar 21 is fixed to the needle 15 helps to achieve good concentricity between the collar and the needle axis. Also, as it is conventional practice to match grind the needle guide 22 to a controlled clearance based on a measurement of the associated bore size 17*b*, the diameter of the collar 21 could also be match ground to a controlled clearance based on a measurement of the corresponding large-diameter region 17*a* of the bore 17.

In an alternative manufacturing method, the collar 21 and the bore 17 are ground with high precision, so that match grinding or otherwise individually matching a needle to a nozzle body is not required. This method reduces the costs of manufacturing injection nozzles according to the invention.

The upstream-facing side 21*b* of the collar 21 is arranged to have a cross-sectional area, perpendicular to the axis of the shaft 15*d*, between 200 and 800 times larger than the total cross-sectional area of the outlets 16 (i.e. the area available for fuel flow through the outlets), and preferably approximately 500 times larger. Providing this area ratio means that the needle will move during closure at approximately the same speed as the fuel in the vicinity of the collar 21.

The collar 21 also helps to reduce pressure waves within the fuel within the bore 17. As the needle 15 and collar 21 move within the bore 17 and as fuel passes through the bore 17, pressure waves are created within the fuel. Because the collar 21 extends across the width of the large-diameter region 17*a* of the bore 17, the collar 21 attenuates or damps the pressure waves by restricting the flow of fuel through the bore 17. The position of the collar 21 on the needle 15 can be selected in order to minimise such pressure waves. For example, the collar 21 may be positioned at or close to an antinode of one of the main resonant pressure waves that arise within the large-diameter region 17*a* of the bore.

Similarly, the collar 21 also acts as a damping element to reduce vibrations in the needle 15 itself. The collar 21 may be positioned at or close to an antinode of one of the main resonant vibrations in the needle 15.

During opening of the needle 15, the resistance against the flow of fuel provided by the large surface area of the upper surface of the collar 21 reduces the speed of the needle. One advantage of this slow opening is that the propensity for needle 'bounce' when the needle 15 reaches its uppermost position is reduced. Such bounce is known to occur in prior art systems due to the needle opening at a very fast speed, and then hitting and bouncing off a stop at the end of its upward travel. This gives rise to undesirable oscillations in the needle and wear of the components of the injection nozzle. Hence, the embodiments of the present invention help to mitigate, or at least minimise, these problems.

Figure 3A:
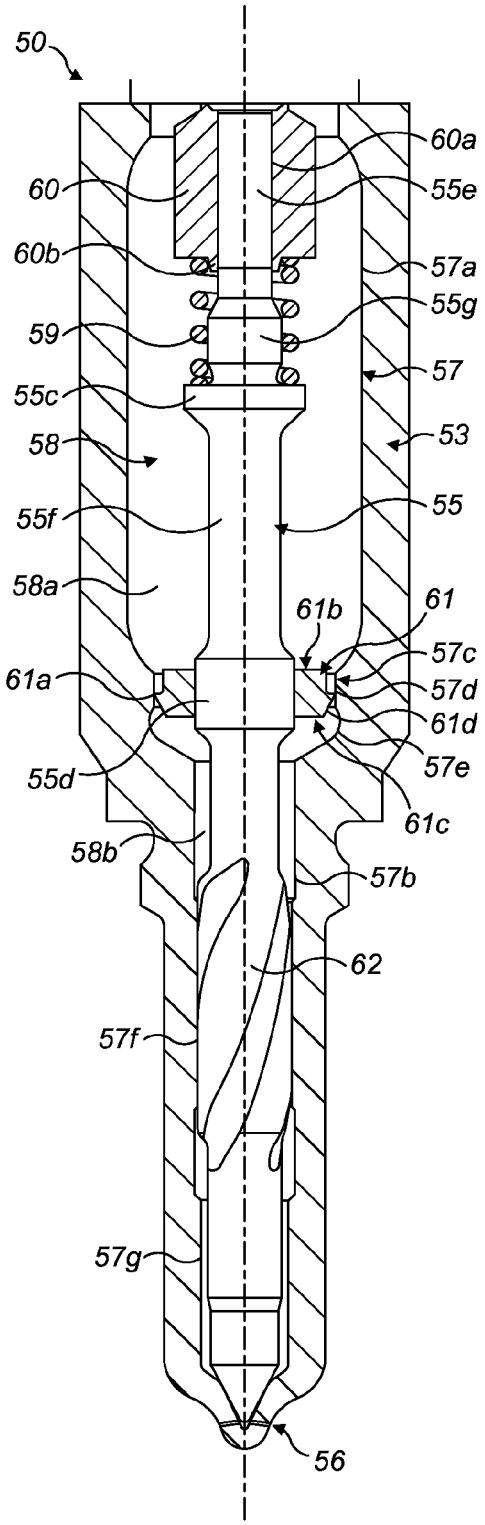
FIG. 3(*a*) is a cross-section of an injection nozzle according to a second embodiment of the present invention.
Figure 3B:
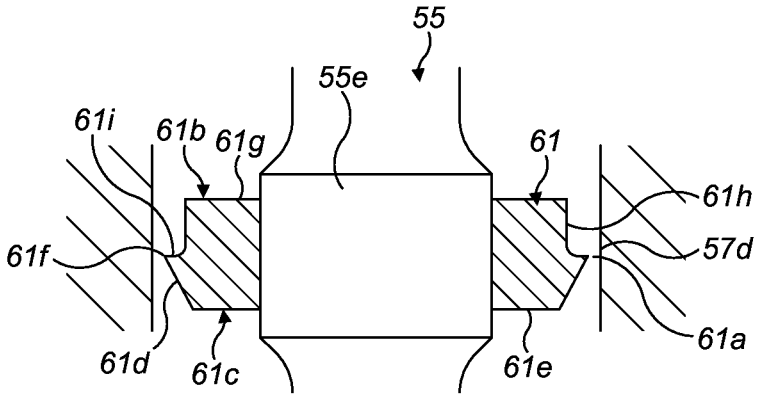

FIG. 3(*a*) shows an injection nozzle 50 according to a second embodiment of the invention which is generally similar to the first embodiment of the invention, and only the differences will be described in detail.

The injection nozzle 50 comprises a valve needle 55 that is slidable within a bore 57 of a nozzle body 53 to control the flow of fuel through a plurality of outlets 56. As in the first embodiment of the invention, in this second embodiment the nozzle body 53 is mounted to a housing part by a cap nut. The housing part and the cap nut are not shown in FIG. 3(*a*).

In this embodiment, the bore 57 includes a relatively large-diameter region 57*a*, and a relatively small-diameter region 57*b*. The large-diameter and small-diameter regions 57*a*, 57*b* are separated by a restriction region 57*c* of intermediate diameter. The restriction region 57*c*, in turn, comprises a cylindrical constant-diameter part 57*d* and a transition part 57*e* which links the constant-diameter part 57*d* to the uppermost end of the small-diameter region 57*b*. The large-diameter region 57*a*, small diameter region 57*b* and restriction region 57*c* together define an accumulator volume 58 for high-pressure fuel.

A restrictive element, in the form of a collar 61, is carried on a cylindrical shaft portion 55*d* of the valve needle 55. The collar 61 is positioned so that it overlaps with the constant-diameter part 57*d* of the restriction region 57*c* of the nozzle body bore 57 over the whole range of movement of the valve needle 55. In this way, the annular restriction 61*a* between the collar 61 and the constant-diameter part 57*d* of the bore 57 (shown most clearly in FIG. 3(*b*)) stays at a constant and well-defined cross-sectional area as the valve needle 55 moves.

Furthermore, by arranging the restriction region 57*c* between the large-diameter and small-diameter regions 57*a*, 57*b* of the bore 57, the bore volume 58*a* upstream of the collar 61 is substantially larger than the bore volume 58*b* downstream of the collar 61. Maximising the upstream bore volume 58*a* and minimising the downstream bore volume 58*b* helps to maximise the efficiency of the restriction 61*a*.

As shown in detail in FIG. 3(*b*), in this embodiment of the invention the collar 61 has an asymmetrical shape, so that the upstream-facing side 61*b* of the collar 61 has a different shape to the downstream-facing side 61*c*. The downstream-facing side 61*c* of the collar has a bevelled or chamfered edge portion 61*d*, as in the first embodiment of the invention. The chamfered edge portion 61*d* is a bevelled surface that extends from the lower face 61*e* of the collar 61 to an outer peripheral edge 61*f*, which defines the maximum diameter of the collar 61, and hence the size of the restriction 61*a*. The upstream-facing side 61*b* of the collar comprises a flat upper central face 61*g* which is stepped at its outer edge to define a peripheral recess or cut-out. A flat base portion of the cut out defines an upstream edge face 61*i* that extends outwardly to meet the peripheral edge 61*f* of the collar 61. The upstream edge face 61*i* is therefore recessed from the central face 61*g* to define a step 61*h*.

In this way, the peripheral edge 61*f* forms a 'sharp' edge or knife edge that defines the restriction 61*a*. In other words, the peripheral edge 61*f* of the collar 61 is defined by a corner where a first surface (the chamfered edge portion 61*d*) meets a second surface (the upstream edge face 61*i*). The first surface is inclined to the axis of the needle 55, and the second surface is perpendicular to the axis of the needle 55. In this embodiment, the peripheral edge 61*f* is half-way between the upper and lower faces 61*g*, 61*e* of the collar 61.

The shape of the collar 61 means that the peripheral edge 61*f* of the collar 61, which defines the restriction 61*a*, is very short in the direction of the needle axis. Furthermore, the chamfered edge portion 61*d* of the collar 61, downstream of the peripheral edge 61*f*, serves to maximise the turbulence of fuel downstream of the collar 61 as the fuel flows through the restriction 61*a*.

Thus, in this second embodiment of the invention, the characteristics of the restriction 61*a* approach those of a sharp-edged orifice, with the advantage that the sensitivity of the restriction to fuel viscosity, and therefore to temperature, is particularly low.

It will be appreciated that the peripheral edge 61*f* cannot, in practice, be perfectly sharp. Instead, the peripheral edge 61*f* forms a generally cylindrical surface with a finite length in the direction parallel to the axis of the needle 55 which, preferably, is less than 0.2 mm. More preferably, the length of the outer edge 61*f* in the direction parallel to the needle axis is not more than 0.1 mm.

In this example, the chamfered edge portion 61*d* of the downstream side 61*c* of the collar 61 is chamfered at an angle of approximately 30° with respect to the needle axis. In other examples, the chamfered edge portion 61*c* may preferably be chamfered at an angle of between approximately 15° and 45° to the needle axis.

Referring again to FIG. 3(*a*), a stem portion 55*f* of the needle 55, upstream of the cylindrical shaft portion 55*d*, has a smaller diameter than the cylindrical shaft portion 55*d*. Advantageously, this reduces the overall mass of the needle 55 compared to the embodiment shown in FIG. 1.

The uppermost end of the stem portion 55*f* is formed into a collar defining an enlarged-diameter spring seat 55*c* for a biasing spring 59. Above the spring seat 55*c*, the valve needle 55 includes a control piston 55*e*, which cooperates with a control chamber (not shown) as in the first embodiment of the invention.

In this second embodiment, the control piston 55*e* is slidable within a bore 60*a* of a spacer piece 60. The spacer piece 60 serves as an upper seat for the spring 59, and spaces the spring 59 from the housing part (not shown). The spacer piece 60 is held against the housing part by the force of the spring 59. The spacer piece 60 can slide sideways to accommodate misalignment of the needle 55 with the housing part, such as might occur due to tolerances in manufacturing.

The spring 59 is maintained in concentric alignment with the axis of the valve needle 55 by way of a spring guide portion 55*g* of the valve needle 55, provided above the spring seat 55*c*. The spring guide portion 55*g* is dimensioned such the spring 59 is slidingly guided on the spring guide portion 55*g*. In addition, the lower surface of the spacer piece 60 is formed with a raised locating ring 60*b* around the entrance to the bore 60*a*. The locating ring 60*b* is dimensioned such that it can be received within the inside diameter of the spring 59. In this way, the locating ring 60*b* locates the spring 59 in a concentric position with respect to the needle axis.

In this embodiment, the small-diameter region 57*b* of the bore 57 of the nozzle body 53 includes a guide region 57*f*, with a decreased inside diameter that is matched to the outside diameter of a guide portion 62 of the needle 55. Similarly, downstream of the guide region 57*f*, the small-diameter region 57*b* of the bore 57 includes a further reduced-diameter portion 57*g*, close to the tip of the nozzle body 53, to reduce the volume of the bore 57 downstream of the restriction 61*a*.

Figure 5:
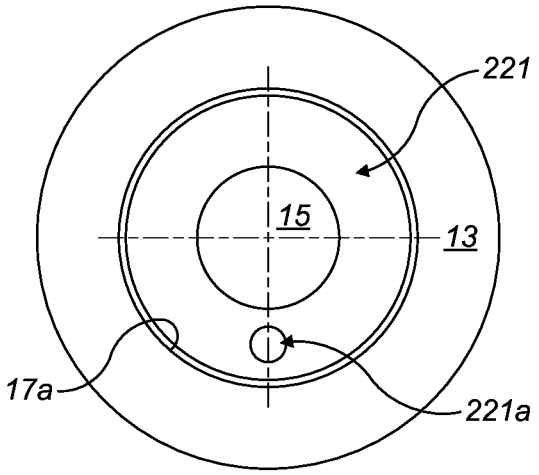
FIG. 5 provides a cross-sectional plan view of part of another injection nozzle according to another arrangement.
Figure 6:
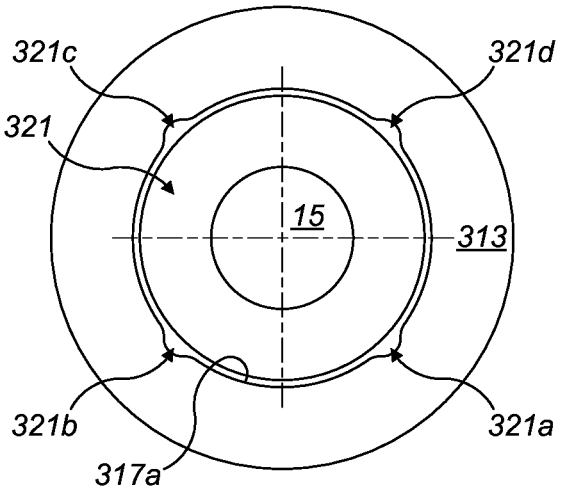
FIG. 6 provides a cross-sectional plan view of part of another injection nozzle according to another arrangement.

In the first and second embodiments of the invention the restriction 21*a*, 61*a* is defined by an annular passage between the outer surface of the collar 21, 61 and the internal surface of the bore 17*a*, 57*c*. However, it will be appreciated that any suitable restriction may be provided, and defined, at least in part, by a collar or any other suitable restrictive element. Three such possible alternative configurations are shown in FIGS. 4, 5 and 6, and discussed in more detail below.

Figure 4:
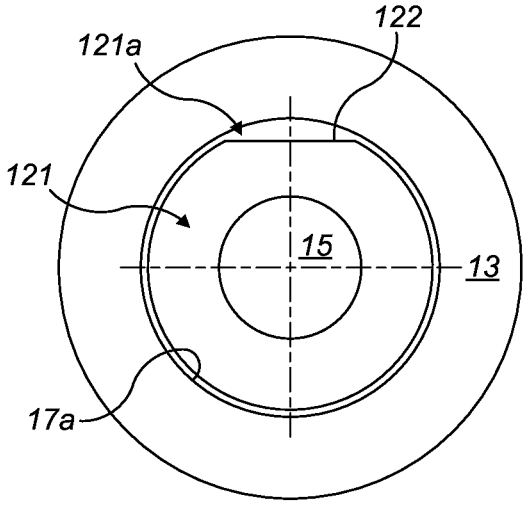
FIG. 4 provides a cross-sectional plan view of part of an injection nozzle according to another arrangement.

FIG. 4 provides a cross-sectional plan view of part of an injection nozzle to illustrate an alternative arrangement. The injection nozzle includes a restrictive element in the form of a collar 121. In this arrangement the collar 121 is provided with a recessed portion comprising a flat 122 on its outer surface which defines, together with the bore 17*a*, the restriction 121*a*. The flat 122 therefore provides an additional flow path for fuel past the collar 121, in addition to the annular flow path defined between the periphery of the collar 121 and the bore 17*a*. The flat 122 can be easily formed by a grinding process in which one side of the collar is flattened. Although only one flat 122 is shown in FIG. 4, in practice a plurality of flats could be provided to avoid unbalanced loads on the collar and the needle.

In another arrangement (not illustrated), the annular edge of the collar is in sliding contact with the inner surface of the large-diameter bore region in the nozzle body so as to allow for free movement of the needle within the bore. In this case, fuel is only able to flow between the flat and the bore, and not around the whole circumference of the collar.

In yet further alternative arrangements (not shown), multiple flats could be provided on the collar, at angularly spaced locations, in order to provide multiple restrictions. The flats are arranged so that the total cross-sectional area provided by the multiple restrictions provides the desired total pressure drop across the collar. Any other shaped recesses or formations, such as a channels or grooves, could be used instead of or in addition to flats.

FIG. 5 provides a cross-sectional plan view of part of an injection nozzle to illustrate another alternative arrangement. Again, the injection nozzle has a restrictive element in the form of a collar 221. In this arrangement, the restriction is provided by an orifice 221*a* in the collar 221*a* in the form of a hole running from the upper surface of the collar 221 to the lower surface. Constructing such an orifice 221*a* can be relatively easy and relatively accurate. In particular, the orifice 221*a* can be drilled into the collar 221.

In this arrangement, the outer circumference of the collar 221 may be arranged to provide a sliding fit with the inner surface of the bore 17 so as to allow sliding movement of the needle 15 within the bore 17. In this case, fuel is only able to flow through the restriction 221*a*, and not around the outer surface of the collar 221.

In yet further arrangements (not shown) multiple orifices can be provided to define a plurality of restrictions through the collar. Orifices can be provided in any shape or form suitable to achieve the required functionality.

FIG. 6 is a cross-sectional plan view of part of an injection nozzle to illustrate a further alternative arrangement having a restrictive element in the form of a collar 321.

In this arrangement, recessed portions 321*a*, 321*b*, 321*c*, and 321*d* are provided in the nozzle body 313, the recessed portions, along with the outer surface of the collar 321 defining restrictions in the fuel flow path past the collar 321. Again, the outer surface of the collar 321 is arranged to provide a sliding fit with the inner surface of the nozzle body 313, so as to allow sliding movement of the needle 15 within the bore region 317*a*. As such, fuel is only able to flow through the restrictions 321*a*, 321*b*, 321*c*, and 321*d*, and not past the remainder of the outer surface of the collar 321. In another embodiment, an annular flow path around the periphery of the collar 321 may also be provided.

It will be appreciated that any suitable number of recessed portions may be provided. The recessed portions could be made by machining the nozzle body to create the recesses, or by incorporating the recess shape into a moulding process for forming the nozzle body.

Any other suitable means for providing a pressure drop across the restrictive element could also be utilised, as could a combination of different types of restriction. Again, the restrictions are arranged so that the total cross-sectional area provided by the restrictions provides the desired total pressure drop.

Figure 7:
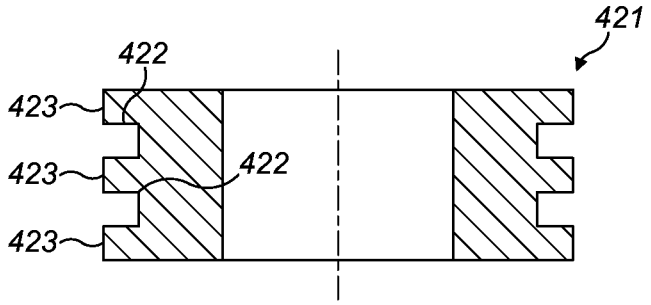
FIG. 7 is a cross-section of a restrictive element for use in an injection nozzle according to another arrangement.

Multiple restrictions can be arranged in series within the fuel flow path through the injection nozzle. For example, FIG. 7 illustrates a cross-section of a restrictive element 421 in the form of a collar for use in an injection nozzle. The collar 421 has two grooves 422 formed circumferentially around its outer peripheral surface. The two grooves 422 in turn define three protruding annular portions 423, which also extend circumferentially around the collar 421.

In this arrangement, the restriction comprises a series of contributory restrictions or sub-restrictions, each sub-restriction being defined between the outer periphery of a respective one of the protrusions 423 and the bore (not shown in FIG. 7). A pressure drop is achieved in each sub-restriction, across each of the protruding portions 423 of the collar 421. The shape and number of the protruding portions 423 are selected so that the sum of the pressure drops across the protruding portions 423 is equal to the total desired pressure drop.

Providing a plurality of protruding portions 423 to define the restriction is advantageous because it makes the manufacturing of the restrictive element 421 easier. The pressure drop across each sub-restriction provided by each protruding portion 423 is lower than if a single restriction were provided.

The diameter of each protruding portion 423 can therefore be reduced compared to a single restriction to make the clearance between the collar 421 and the bore larger, and in turn a given diameter tolerance of a protruding portion 423 will have a smaller effect on the area compared with the single-restriction case.

While FIG. 7 illustrates the use of grooves on a collar generally of the type shown in FIG. 1, it will be appreciated that the grooves could be applied to any form of restrictive element. For example, the grooves could be provided along the flat of the collar shown in FIG. 4, the orifice of the collar shown in FIG. 5 or the recesses of the bore shown in FIG. 6.

It will be appreciated that the features of the embodiments of the invention described in FIGS. 1(*a*) to 3(*b*) could be applied, where appropriate, to the arrangements of FIGS. 4 to 7. For example, a bevelled surface could be provided on the downstream side of the collars of FIGS. 4 to 6, or on the downstream side of one or more of the protruding portions of the collar of FIG. 7.

Figure 8:
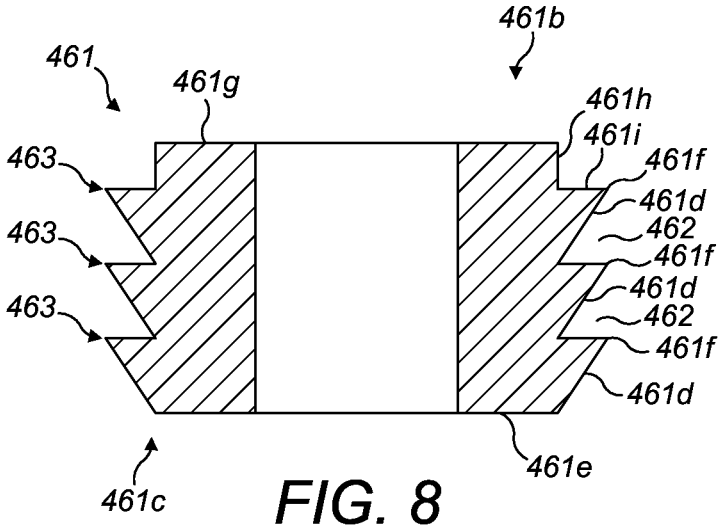
FIG. 8 is a cross-section of a restrictive element for use in an injection nozzle according to a third embodiment of the present invention.

For example, FIG. 8 illustrates a cross-section of a restrictive element 461 in the form of a collar for use in an injection nozzle according to a third embodiment of the invention. As in the collar shown in FIG. 7, the collar 461 shown in FIG. 8 comprises three protruding annular portions 463, which extend circumferentially around the outer peripheral surface of the collar 461. The annular protrusions 463 are separated by circumferential grooves 462 formed in the peripheral surface of the collar 461.

Each of the annular protrusions 463 has, on its downstream side, a chamfered or bevelled surface 461*d* that extends to a respective outer peripheral edge 461*f* of the annular portion 463. The bevelled surface 461*d* of the annular protrusion 463 closest to the downstream side 461*c* of the collar is formed at the periphery of a central face 461*e* of the downstream side 461*c*. The central face 461 is normal to the needle axis.

The upstream side 461*b* of the collar 461 comprises an upstream edge face 461*i* which is recessed from a central face 461*g* to define a step 461*h*. The upstream edge face 461*i* and the central face 461*g* are normal to the needle axis. The upstream edge face 461*i* extends to the outer peripheral edge 461*f* of the annular protrusion 463 closest to the upstream side 461*b* of the collar 461.

As in the FIG. 7 arrangement, in the collar of FIG. 8 the restrictive element provides a restriction formed from a series of contributory restrictions or sub-restrictions, each sub-restriction being defined between the outer peripheral edge 461*f* of a respective one of the protrusions 463 and the bore (not shown in FIG. 8). Furthermore, by virtue of the bevelled surfaces 461*d*, each of the sub-restrictions is defined by a sharp edge, giving the benefits described above with reference to FIGS. 3(*a*) and 3(*b*).

Figure 9:
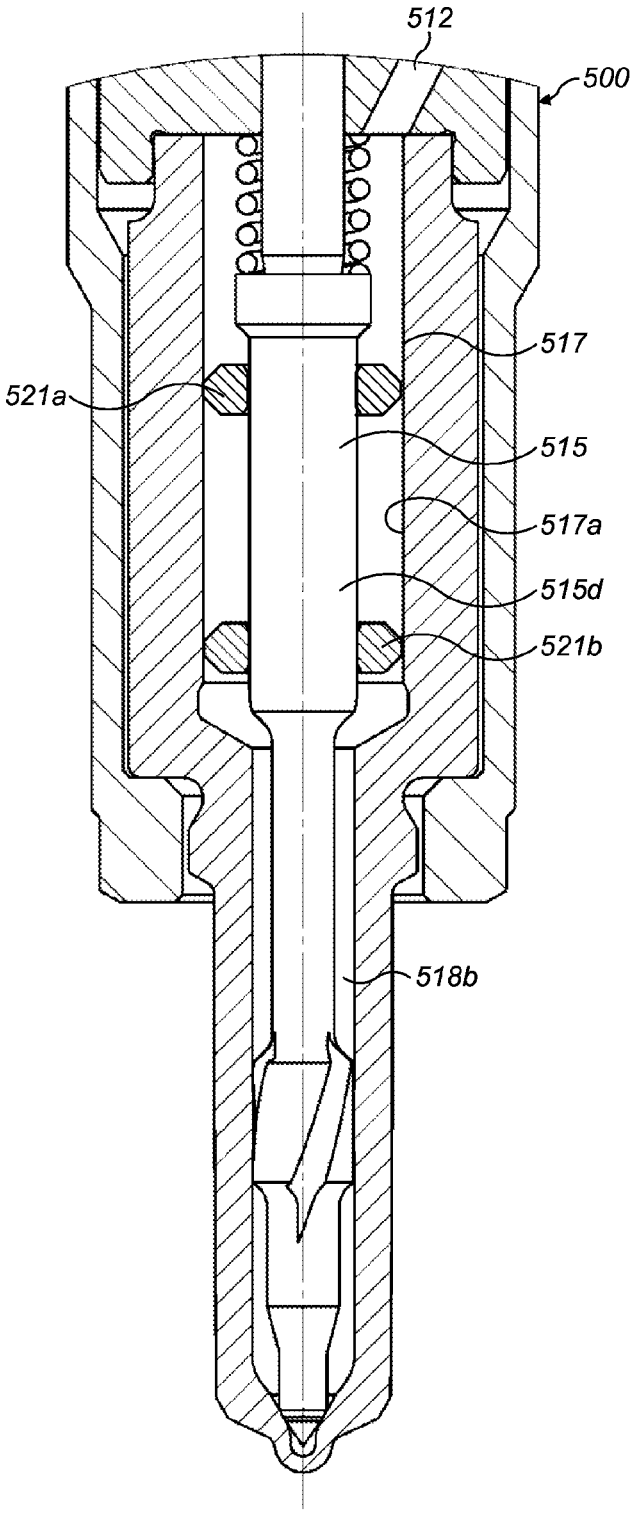
FIG. 9 is a cross-section of an injection nozzle according to a fourth embodiment of the present invention.

FIG. 9 provides a cross-section of a fuel injection nozzle 500 according to a fourth embodiment of the present invention. The fuel injection nozzle 500 depicted in FIG. 9 differs from the injection nozzle depicted in FIG. 1(*a*) in that it includes two restrictive elements, each of which takes the form of a collar 521*a*, 521*b* which have the same shape as the collar 21 of the first embodiment of the invention illustrated in FIGS. 1(*a*) and 1(*b*). The collars 521*a*, 521*b* are spaced apart along a generally cylindrical shaft portion 515*d* of the needle 515.

Each collar 521*a*, 521*b* defines a respective sub-restriction between the collar 521*a*, 521*b* and the bore 517. The sub-restrictions are arranged in series to provide the desired pressure drop between the supply passage 512 and the bore volume 518*b* between the lowermost collar 512*b* and the tip of the nozzle 500. By providing a plurality of sub-restrictions in place of one single restriction, the clearances between the collars 521*a*, 521*b* and the bore 517 can be increased, thereby reducing the effect of any diameter variations due to manufacturing tolerances.

By providing two collars 521*a*, 521*b*, it is possible to further damp oscillations within the fuel in the bore 517 and in the needle 515. The two collars 521*a*, 521*b* can be positioned in order to minimise oscillations in the fuel within the bore 517. For example, each collar 521*a*, 521*b* can be positioned at an antinode of one of the main resonant oscillations in the fuel within the large-diameter region 517*a* of the bore 517, and/or at an antinode of one of the main resonant oscillations in the needle itself. It will be appreciated that further collars could be provided in order to reduce oscillations.

In this embodiment the collars are identical and the required pressure drop is split between the two collars. However, it will be appreciated that the two collars could be different and different pressure drops could occur across each collar. It would also be possible to provide a first collar that provides the whole required pressure drop, and a second collar that does not provide a pressure drop, but instead is utilised purely to dampen waves within the bore. In such an embodiment, the collars may be referred to as "restrictive collars" or "damping collars".

In a variation of the fourth embodiment of the invention, collars having a shape as shown in FIGS. 3(*a*) and 3(*b*), or as shown in FIG. 7 or 8, could be used.

Several modifications and variations of the present invention can be contemplated. For example, in another embodiment of the invention, not depicted, the collar supports the lower end of the spring. That is, the collar defines a spring seat arranged to engage the spring between an upper surface of the collar and the injector body. In this embodiment, the number of components required in the injector is reduced and as such a simpler injector is provided. In other embodiments, the spring could be provided in the control chamber or elsewhere.

In the illustrated embodiments, the needle is housed in a bore in a single-piece nozzle body. However, the needle could instead be housed in a multi-part nozzle body, in which case the bore could be formed of a plurality of coaxially-arranged bores. The bore may also extend into, or be provided in, a component upstream of the nozzle body.

The control piston may be formed as an end region of the valve needle. Alternatively, the control piston could be a separate part that is associated with the needle, such that movement of the control piston is transferred to the needle.

Further modifications and variations not explicitly described above could also be made by a person skilled in the art without departing from the scope of the invention as defined in the appended claims.

The invention claimed is:

1. An injection nozzle for injecting fuel into a combustion chamber of an internal combustion engine, the injection nozzle comprising:

a nozzle body having a bore for receiving fuel from a supply line for pressurised fuel;

an outlet from the bore for delivering fuel to the combustion chamber, in use; and a valve needle defining a needle axis and being slidable within the bore between a closed state in which fuel flow through the outlet into the combustion chamber is prevented, and an injecting state in which fuel flow through the outlet into the combustion chamber is enabled, movement of the needle being controllable by varying the fuel pressure within a control chamber, in use;

the needle comprising a needle guide portion arranged to guide sliding movement of the needle within the bore;

the injection nozzle further comprising a restriction within the bore for restricting the flow of fuel through the bore, and a restrictive element having an upstream side and a downstream side; the restrictive element being moveable with the needle and located upstream of the needle guide portion;

wherein the restriction is defined between the bore and a peripheral edge of the restrictive element, and wherein, when the needle is in the injecting state in use, the pressure of fuel at the outlet is substantially the same as the pressure of fuel in the bore immediately downstream of the restrictive element and is less than the pressure of fuel supplied to the bore from the supply line;

characterised in that at least a part of the downstream side of the restrictive element comprises a bevelled surface that extends to the peripheral edge, the bevelled surface being non-perpendicular to the needle axis;

wherein the restrictive element has a larger diameter than the needle guide portion of the needle;

wherein the downstream side of the restrictive element comprises a downstream face that is normal to the needle axis, and wherein the bevelled surface is formed as a chamfer at the periphery of the downstream face.

2. An injection nozzle according to claim 1, wherein the bevelled surface is frustoconical.

3. An injection nozzle according to claim 1, wherein the bevelled surface lies at an angle of between approximately 15° and 45° with respect to the needle axis.

4. An injection nozzle according to claim 3, wherein the bevelled surface lies at an angle of approximately 30° with respect to the needle axis.

5. An injection nozzle for injecting fuel into a combustion chamber of an internal combustion engine, the injection nozzle comprising:

a nozzle body having a bore for receiving fuel from a supply line for pressurised fuel;

an outlet from the bore for delivering fuel to the combustion chamber, in use; and a valve needle defining a needle axis and being slidable within the bore between a closed state in which fuel flow through the outlet into the combustion chamber is prevented, and an injecting state in which fuel flow through the outlet into the combustion chamber is enabled, movement of the needle being controllable by varying the fuel pressure within a control chamber, in use;

the needle comprising a needle guide portion arranged to guide sliding movement of the needle within the bore;

the injection nozzle further comprising a restriction within the bore for restricting the flow of fuel through the bore, and a restrictive element having an upstream side and a downstream side; the restrictive element being moveable with the needle and located upstream of the needle guide portion;

wherein the restriction is defined between the bore and a peripheral edge of the restrictive element, and wherein, when the needle is in the injecting state in use, the pressure of fuel at the outlet is substantially the same as the pressure of fuel in the bore immediately downstream of the restrictive element and is less than the pressure of fuel supplied to the bore from the supply line;

characterised in that at least a part of the downstream side of the restrictive element comprises a bevelled surface that extends to the peripheral edge, the bevelled surface being non-perpendicular to the needle axis;

wherein the restrictive element has a larger diameter than the needle guide portion of the needle;

wherein the upstream side of the restrictive element comprises an upstream edge face (61*i*) that extends to the peripheral edge of the restrictive element;

wherein the upstream side of the restrictive element comprises a central face, and wherein the upstream edge face is annularly disposed around the central face;

wherein the upstream edge face is recessed from the central face to define a step between the upstream edge face and the central face.

6. An injection nozzle according to claim 5, wherein the upstream edge face is normal to the needle axis.

7. An injection nozzle according to claim 5, wherein the peripheral edge of the restrictive element is defined where the upstream edge face and the bevelled surface meet.

8. An injection nozzle for injecting fuel into a combustion chamber of an internal combustion engine, the injection nozzle comprising:

a nozzle body having a bore for receiving fuel from a supply line for pressurised fuel;

an outlet from the bore for delivering fuel to the combustion chamber, in use; and a valve needle defining a needle axis and being slidable within the bore between a closed state in which fuel flow through the outlet into the combustion chamber is prevented, and an injecting state in which fuel flow through the outlet into the combustion chamber is enabled, movement of the needle being controllable by varying the fuel pressure within a control chamber, in use;

the needle comprising a needle guide portion arranged to guide sliding movement of the needle within the bore;

the injection nozzle further comprising a restriction within the bore for restricting the flow of fuel through the bore, and a restrictive element having an upstream side and a downstream side; the restrictive element being moveable with the needle and located upstream of the needle guide portion;

wherein the restriction is defined between the bore and a peripheral edge of the restrictive element, and wherein, when the needle is in the injecting state in use, the pressure of fuel at the outlet is substantially the same as the pressure of fuel in the bore immediately downstream of the restrictive element and is less than the pressure of fuel supplied to the bore from the supply line;

characterised in that at least a part of the downstream side of the restrictive element comprises a bevelled surface that extends to the peripheral edge, the bevelled surface being non-perpendicular to the needle axis;

wherein the restrictive element has a larger diameter than the needle guide portion of the needle;

wherein at least a part of the upstream side of the restrictive element comprises a bevelled surface that extends to the peripheral edge, the bevelled surface being non-perpendicular to the needle axis.

9. An injection nozzle according to claim 1, wherein the peripheral edge has a length of approximately 0.2 mm or less in a direction parallel to the needle axis.

10. An injection nozzle according to claim 9, wherein the peripheral edge has a length of approximately 0.1 mm or less in the direction parallel to the needle axis.

11. An injection nozzle according to claim 1, comprising a first bore volume upstream of the restriction and arranged to receive fuel from the supply line, and a second bore volume downstream of the restriction and arranged to receive fuel from the first bore volume through the restriction; wherein the needle guide portion of the needle is disposed within the second bore volume.

12. An injection nozzle according to claim 11, wherein the restrictive element comprises an upstream-facing thrust surface which is exposed to fuel pressure in the first bore volume in use.

13. An injection nozzle according to claim 11, wherein the needle comprises at least one downstream-facing thrust surface which is exposed to fuel pressure in the second bore volume in use.

14. An injection nozzle according to claim 1, wherein the needle includes a shaft portion, and wherein the restrictive element comprises a collar disposed annularly around the shaft portion.

15. An injection nozzle according to claim 14, further comprising a control piston associated with the needle and having a control surface exposed to fuel pressure within the control chamber; wherein the collar has a larger diameter than the piston.

16. An injection nozzle according to claim 1, wherein the bore includes a region of relatively large diameter in which the restrictive element is disposed and a region of relatively small diameter in which the needle guide portion of the valve needle is disposed.

17. An injection nozzle according to claim 16, wherein the restrictive element is disposed at a downstream end portion of the region of relatively large diameter.

18. An injection nozzle according to claim 1, wherein the bore includes a region of relatively large diameter upstream of the restrictive element, a region of relatively small diameter in which the needle guide portion of the valve needle is disposed, and a region of intermediate diameter in which the restrictive element is disposed.

19. An injection nozzle for injecting fuel into a combustion chamber of an internal combustion engine, the injection nozzle comprising:

a nozzle body having a bore for receiving fuel from a supply line for pressurised fuel;

an outlet from the bore for delivering fuel to the combustion chamber, in use; and a valve needle defining a needle axis and being slidable within the bore between a closed state in which fuel flow through the outlet into the combustion chamber is prevented, and an injecting state in which fuel flow through the outlet into the combustion chamber is enabled, movement of the needle being controllable by varying the fuel pressure within a control chamber, in use;

the needle comprising a needle guide portion arranged to guide sliding movement of the needle within the bore;

the injection nozzle further comprising a restriction within the bore for restricting the flow of fuel through the bore, and a restrictive element having an upstream side and a downstream side; the restrictive element being moveable with the needle and located upstream of the needle guide portion;

wherein the restriction is defined between the bore and a peripheral edge of the restrictive element, and wherein, when the needle is in the injecting state in use, the pressure of fuel at the outlet is substantially the same as the pressure of fuel in the bore immediately downstream of the restrictive element and is less than the pressure of fuel supplied to the bore from the supply line;

characterised in that at least a part of the downstream side of the restrictive element comprises a bevelled surface that extends to the peripheral edge, the bevelled surface being non-perpendicular to the needle axis;

wherein the restrictive element has a larger diameter than the needle guide portion of the needle;

wherein the restrictive element is provided with a plurality of annular protrusions, and wherein the restriction comprises, at least in part, a series of sub-restrictions, each sub-restriction being defined between the outer periphery of a respective one of the protrusions and the bore.

20. An injection nozzle according to claim 19, wherein the downstream side of one or more of the annular protrusions comprises a bevelled surface which is inclined to the needle axis.

21. An injection nozzle according to claim 1, wherein the restrictive element is dimensioned such that, when the valve needle is in the injecting state in use, the flow rate of fuel in the bore is approximately equal to the rate at which the valve needle moves during movement of the valve needle from the injecting state to the closed state.

22. An injection nozzle according to claim 1, wherein the restrictive element is positioned at an antinode of a characteristic standing wave in the bore.

23. An injection nozzle according to claim 1, comprising a plurality of restrictive elements spaced apart along the valve needle.

24. An injection nozzle according to claim 1, further comprising a spring for urging the needle towards the closed position, wherein the needle comprises a spring seat for the spring that is disposed upstream of the restrictive element.

25. An injection nozzle according to claim 1, wherein the needle includes a shaft portion, and wherein the restrictive element is integrally formed with the shaft portion of the needle.

* * * * *